United States Patent [19]

Deutschmann et al.

[11] 4,417,555

[45] Nov. 29, 1983

[54] FUEL INJECTION PUMP ARRANGEMENT

[75] Inventors: Herbert Deutschmann; Ewald Kamleitner, both of Friedrichshafen, Fed. Rep. of Germany

[73] Assignee: Motoren-und Turbinen-Union Friedrichshafen GmbH, Fed. Rep. of Germany

[21] Appl. No.: 200,383

[22] Filed: Oct. 24, 1980

[30] Foreign Application Priority Data

Jan. 15, 1980 [DE] Fed. Rep. of Germany ..... 3001162

[51] Int. Cl.[3] ..... F02D 17/00

[52] U.S. Cl. ..... 123/372; 123/198 F

[58] Field of Search ..... 123/198 F, 372, 198 FB, 123/364, 365, 385

[56] References Cited

U.S. PATENT DOCUMENTS 1,967,101 7/1934 Rassbach ..... 123/198 F
3,815,563 6/1974 Stinsa ..... 123/198 F
4,161,166 7/1979 Roznovsky ..... 123/198 F
4,297,979 11/1981 Kamleitner ..... 123/198 F

FOREIGN PATENT DOCUMENTS 2822195 11/1979 Fed. Rep. of Germany ..... 123/372

*Primary Examiner*—William A. Cuchiniski, Jr.
*Assistant Examiner*—Carl Stuart Miller
*Attorney, Agent, or Firm*—Craig and Burns

[57] ABSTRACT

A device for a fuel injection pump for a piston internal combustion engine which includes an adjustable regulator rod associated with the fuel injection pump. The regulator rod includes two regulator parts that may be moved axially toward each other. A spring is provided for acting upon the two regulator rod parts with one of the regulator rod parts being adapted to be stopped by a checking or stopping device. A power source that can be selectively cut in or out is provided so as to selectively remove a force effect of the spring on the two regulator rod parts.

12 Claims, 3 Drawing Figures

FUEL INJECTION PUMP ARRANGEMENT

The present invention relates to a fuel injection arrangement and, more particularly, to a fuel injection pump for a reciprocating piston internal combustion engine, with the pump having a chamfered or bevelled control edge, wherein an adjustable regulator rod is associated with the fuel injection pump, with the regulator rod being formed of two regulator rod parts that may be axially moved toward each other, and with a spring means that acts between adjacent faces of the two regulator rod parts, with one of the regulator rod parts being stopped by a check or abutment means.

In order to selectively cut off the fuel supply to one or more cylinders of a reciprocating piston internal combustion engine, a portion of the pump cylinders of the fuel injection pump associated with the cylinders of the engine are temporarily set or placed in a zero delivery condition. For this purpose, in, for example, German Offenlegungsschrift Nos. 28 18 524, 28 21 161 and 28 22 195, fuel injection pumps are proposed which are provided with a divided regulator rod.

A disadvantage of the above proposed fuel injection pump arrangements resides in the fact that, with a movement of the regulator rod part that is not fixedly held, there is an undesired reactive effect on the setting member that effects the movement of the regulator rod. This reactive effect results from the fact that, when a check device is actuated, the spring means no longer acts within the regulator rod. By the fixing of one regulator part, the spring means acting between adjacent faces of the two regulator rod parts, braces, on the one hand, the regulator rod part that can be further axially moved and, on the other hand, on stationary parts of the fuel injection pump. The force of the spring means acting on the movable regulator rod part must supplementarily be overcome by the setting member.

The aim underlying the present invention essentially resides in providing a device for holding one regulator rod part, the actuation of which will not trigger a disadvantageous reactive effect on the setting member of the fuel injection pump.

In accordance with advantageous features of the present invention, a device for a fuel injection pump with a chamfered or bevelled control edge for a piston internal combustion engine is provided wherein a power source which may be selectively cut in or out is provided whereby the force effect of the spring means between the two regulator rod parts can be removed.

In accordance with the present invention, a check device is provided which includes a first cylinder piston unit cooperating with one regulator rod part and a housing. The power source includes a second cylinder piston unit cooperating with the first cylinder piston unit and the spring means.

Advantageously, an annular piston of the first cylinder piston unit, connected with one regulator rod part and guided in the housing, and a piston guided inside the annular piston and slidable with reference to the regulator rod part is associated with the second cylinder piston unit.

In accordance with still further features of the present invention, both cylinder piston units may be simultaneously impinged upon with a pressure means through overflow openings provided in the annular piston.

Advantageously, the spring means are disposed between the annular piston and the piston guided inside the annular piston with a cylinder sleeve being disposed to float coaxially thereto constituting the cylinder for the annular piston.

A spring may be disposed between the cylinder sleeve and the check ring and an annular gap may be provided between the cylinder sleeve and the check ring which serves to supply a pressure medium to the first cylinder piston unit.

In accordance with still further features of the present invention, the piston guided inside the annular piston is applied with one face to a shoulder of the other regulating rod part with a spring being disposed between the other face of the piston and a stop or abutment provided on the rod part.

By virtue of the above-noted features of the present invention, the characteristics of the setting member will no longer be undesirably changed, and the space for incorporation or accommodation of the spring means is independent of the dimensions of the regulator rod parts. Moreover, there is good accessibility for assemblying the two cylinder piston units, and, by virtue of the provision of a supplementary spring that acts on the regulator rod part that is still movable when one regulator rod part is in the cut off position, there results a balancing of play and a desired slight support for the setting member that occurs in the setting direction toward an increased fuel delivery.

Accordingly, it is an object of the present invention to provide a fuel injection arrangement which avoids, by simple means, shortcomings and disadvantages encountered in the prior art.

Another object of the present invention resides in providing a device for a fuel injection pump for a reciprocating piston internal combustion engine which minimizes, not avoids undesirable changing of a setting member of the fuel pump.

A still further object of the present invention resides in providing a fuel injection pump for a reciprocating piston internal combustion engine which functions reliably under all operating conditions.

A still further object of the present invention resides in providing a fuel injection pump for a reciprocating piston internal combustion engine having an adjustable bipartite regulator rod.

These and other objects, features, and advantages of the present invention will become more apparent from the following description when taken in connection with the accompanying drawing which shows, for purposes of illustration only, one embodiment in accordance with the present invention, and wherein.

Figures 1, 2, 3:
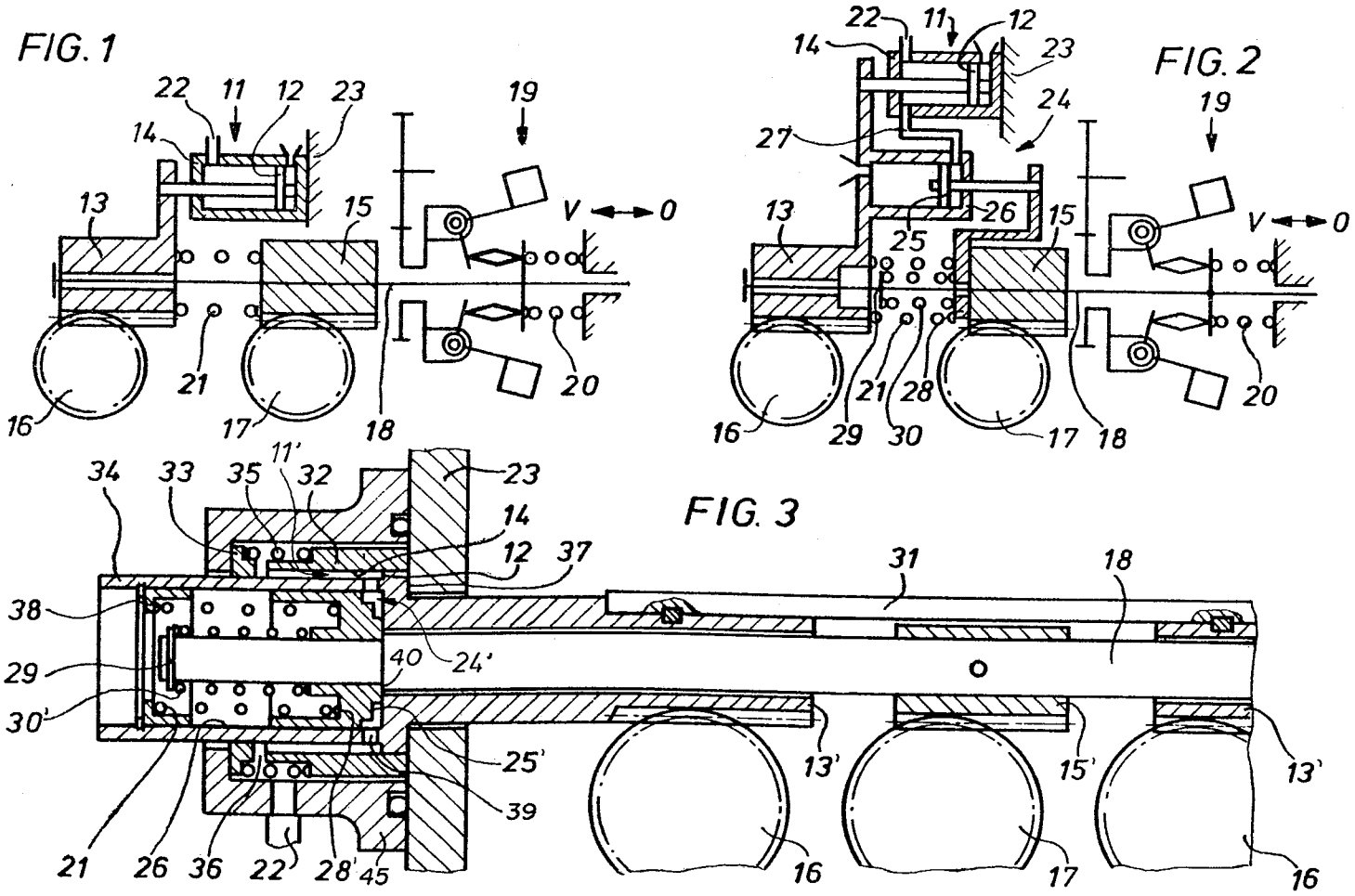
FIG. 1 is a schematic cross-sectional view of a fuel injection pump arrangement with a proposed check device.
FIG. 2 is a schematic cross-sectional view of a device for a fuel injection pump in accordance with the present invention.
FIG. 3 is a longitudinal cross-sectional view of a fuel injection pump with a divided regulating rod in accordance with the present invention.

Referring now to the drawing wherein like reference numerals are used throughout the various views to designate like parts and, more particularly, to FIG. 1, according to this figure, a fuel injection pump with a chamfered or bevelled control edge for controlling a fuel supply to a piston internal combustion engine includes a regulator rod adapted to cooperate with pump cylinders 16, 17, with a movement of the regulator rod causing a rotation of the pump cylinders 16, 17 to achieve a desired fuel delivery setting for various operational states of the internal combustion engine. To enable a temporary cutting off or shutting off of fuel delivery to some of the work cylinders of the internal combustion engine, the regulator rod includes two regulator rod parts 13 and 15 that can be moved axially toward each other with the regulator rod part 13 being adapted to be fixedly held in a zero delivery setting upon an actuation of a check device generally designated by the reference numeral 11.

The regulator rod part 15 is connected through a rod part 18 with a fuel-setting member such as, for example, a centrifugal governor or speed regulator generally designated by the reference numeral 19 which, in a conventional manner, works in opposition to a regulator spring 20. An output setting member (not shown) of an associated internal combustion engine is adapted to engage a rod part 18. The regulator rod part 13 is movably disposed on the rod part 18 and is coupled by a spring means 21 with the other regulator rod part 15 so that both regulator rod parts 13 and 14 follow the motion of the rod part 18.

The check device 11 includes a piston 12 fixedly connected with the regulator rod part 13. The piston 12 is reciprocatingly movable in a cylinder 14 connected with a housing 23 of the fuel injection pump. When there is no pressure in a line or conduit 22, the regulator rod part 13 moves, without hindrance, with the piston 12. To cut off a cylinder, the piston 12 is acted upon by a pressure medium and thus, together with the regulator rod part 13, piston 12 is held in a nondelivery position. If, when a cylinder is cut off, the regulator rod part 15 is moved in a direction toward an increased fuel delivery by the setting member acting on the rod part 18, there is a force effect of the spring means 21 between the fixedly held regulator rod part 13 and the regulator rod part 15 that is to be moved, with force being directed in the opposite direction to the setting force acting upon the setting member. By virtue of the existence of the counter force, a given characteristic of the setting member from the regulatory spring 20 and centrifugal regulator 19 is undesirably falsified when the cylinder of the engine is cut off.

As shown in FIG. 2, the spring means, on the one hand, directly engages regulator rod part 13 and, on the other hand, a spring bearing or plate 28 disposed between the spring means 21 and regulator rod part 15. The spring plate or bearing 28 is movable with respect to both the rod part 18 and regulator rod part 15.

Cylinder 26 is fixedly connected with the regulator rod part 13. A piston 25 is disposed in the cylinder 26 and is fixedly connected with the spring plate or bearing 28. The cylinder 26 and piston 25 form a power source generally designated by the reference numeral 24 whereby, by delivery of a pressure medium from the cylinder chamber of the check device 11 through a conduit or line 27, the piston 25 is moved in a direction toward the regulator rod part 13. By this movement of the piston 25, the spring plate or bearing 28 is released from the regulator rod part 15 since, in the illustrated embodiment of FIG. 2, the piston 12 of the check device 11 is fixedly held in the illustrated position so that the coupling effect of the spring means between the rod parts 13, 15 is removed.

With a supply of pressure medium through the line 22 and line 27, the check device 11 and power source 24 go into a "cut off" position, and the regulator rod part 15 can then be adjusted by the setting member without being influenced whatsoever by the spring means 21.

A spring 30 is disposed between the spring plate or bearing 28 and a stop or abutment 29 provided on rod part 18. The spring 30 exerts a force on the rod part 18 in the "cut off" position of the spring plate or bearing 28 and has the same direction of effect as the regulator spring 20. The force of the spring 30 is slight or small and, on the one hand, serves for a balancing of play and, on the other hand, adjusts the regulator rod part 15 slightly in a direction toward a higher delivery output and, in this manner, eliminates an observed power break-in of the other cylinders when some cylinders of the piston internal combustion engine are cut off.

In the longitudinal partial cross-sectional view of the fuel injection pump of FIG. 3, a regulator rod, of which only a short section is shown, includes regulator rod parts 13' and 15' that are alternatingly arranged so as to follow one another. The regulator rod parts 15' are fixedly connected with rod part 18 which is engaged by a setting member (not shown). The regulator rod parts 15' act together with pump cylinders 17 so as to cause rotation of pump cylinders 17 into a desired delivery setting. The regulator rod parts 13' are movable on rod part 18 and are interconnected by a connecting strap 31. The regulator rod parts 13' cooperate with the pump cylinders 16 of the injection pump so as to provide for a desired delivery setting.

As shown in FIG. 3, a check device generally designated by the reference numeral 11' and a power source generally designated by the reference numeral 24' are provided, each of which are formed as a cylinder piston unit, with the cylinder-piston units being disposed on an end of the control rods. The cylinder piston unit forming the check device 11' includes a cylinder sleeve 32 disposed in a manner so as to float inside a housing 45, with an annular stop 33 that is also floatingly disposed inside the housing. An annular surface of an annular piston 34, connected with regulator rod part 13', forms a piston 12', corresponding to the piston 12 in the check device 11. In order to enable an axial tensioning of the cylinder sleeve 32 and stop ring 33, a spring 35 is disposed between the cylinder sleeve 32 and stop ring 33. A pressure medium is delivered through a line 22 and reaches the cylinder chamber upstream of the piston 34 and, through an annular gap 36 between sleeve 32 and ring 33 acts so as to hold the annular piston 34 fixedly on a stop surface 37.

The cylinder piston unit of the power source 24' includes an internal bore of annular piston 34 that forms cylinder 26 and piston 25' that is disposed in cylinder 26 and movable on rod part 18. The piston 25 is formed on a rear surface thereof as a spring plate or bearing 28'. The spring means 21, constructed as a compression spring, bears on the one hand, on the spring plate or bearing 28 and, on the other hand, on a stop ring 38 disposed in the cylinder 26. Delivery of pressure medium for actuation of the power source 24' is effected through openings 39 in the annular piston that correspond to the conduit or line 27 of the FIG. 2 embodiment. A spring 30', corresponding to the spring 30, is disposed between the piston 25' that is movable against the spring 30 and is applied with one face on a shoulder 40 of a rod part 18 and a stop or abutment 29 on the end of the rod part 18.

As can readily be appreciated, actuation of the check device 11 or 11' and power source 24 or 24' is not confined to the use of a pressure medium such as oil. Any other medium with suitable pressure such as, for example, fuel or air, can be utilized just as well.

While we have shown and described only two embodiments in accordance with the present invention, it is understood that the same is not limited thereto but is susceptible of numerous changes and modifications as known to one having ordinary skill in the art, and we therefore do not wish to be limited to the details shown and described herein, but intend to cover all such changes and modifications as are encompassed by the scope of the appended claims.

We claim:

1. A fuel injection pump arrangement for an internal combustion engine, the arrangement comprising adjustable regulator rod means for controlling a fuel delivery setting to the internal combustion engine, the regulator rod means including a first and second regulator rod part, means for mounting the first and second regulator rod parts so as to be axially movable toward and away from each other, spring means acting upon the first and second regulator rod parts so as to provide a reactive effect on a setting member of the fuel injection pump arrangement, and means for selectively stopping one of the first and second regulator rod parts from moving, characterized in that means are provided for selectively removing a force effect of the spring means acting upon the first and second regulator rod parts, the force effect removing means is an independent power source, the selective stopping means includes a first cylinder piston means adapted to cooperate with one of the first and second regulator rod parts and a housing, and in that the power source includes a second cylinder piston means cooperating with the first cylinder piston means and with the spring means, the first cylinder piston means includes an annular piston guided in the housing and connected with one of the first and second regulator rod parts and a piston means guided interiorly of the annular piston and slidable with respect to the other of the first and second regulator rod parts, and in that the other of the first and second regulator rod parts, and in that the other of the first and second regulator rod parts is operatively associated with the second cylinder piston means, means are provided for enabling the first and second cylinder piston means to be simultaneously acted upon by a pressure medium, the enabling means includes overflow openings provided in the annular piston, spring means are disposed between the annular piston and the piston means, and a cylindrical sleeve is disposed so as to float in the housing, a check ring is disposed so as to float in the housing coaxially to the cylindrical sleeve, and in that the cylindrical sleeve and check ring form a cylinder for the annular piston.

2. An arrangement according to claim 1, characterized in that a further spring means is arranged between the cylindrical sleeve and the check ring for axially tensioning the cylindrical sleeve and the check ring.

3. An arrangement according to claim 2, characterized in that an annular gap is formed between the cylindrical sleeve and the check ring for enabling a supply of pressure medium to the first cylinder-piston means.

4. An arrangement according to claim 3, characterized in that one face of the piston means acts upon a shoulder of the other of said first and second regulator rod parts, and in that an additional spring means is disposed between the other face of the piston means and a stop provided on an additional regulator rod part.

5. A fuel injection pump arrangement for an internal combustion engine, the arrangement comprising adjustable regulator rod means for controlling a fuel delivery setting to the internal combustion engine, the regulator rod means including a first and second regulator rod part, means for mounting the first and second regulator rod parts so as to be axially movable toward and away from each other, spring means acting upon the first and second regulator rod parts so as to provide a reactive effect on a setting member of the fuel injection pump arrangement, and means for selectively stopping one of the first and second regulator rod parts from moving, characterized in that means are provided for selectively removing a force effect of the spring means acting upon the first and second regulator rod parts, the force effect removing means is an independent power source, the selective stopping means includes a first cylinder piston means adapted to cooperate with one of the first and second regulator rod parts and a housing, and in that the power source includes a second cylinder piston means cooperating with the first cylinder piston means and with the spring means, the first cylinder piston means includes an annular piston guide in the housing and connected with one of the first and second regulator rod parts and a piston means guided interiorly of the annular piston and slidable with respect to the other of the first and second regulator rod parts, and in that the other of the first and second regulator rod parts is operatively associated with the second cylinder piston means, and a cylindrical sleeve is disposed so as to float in the housing, a check ring is disposed so as to float in the housing coaxially to the cylindrical sleeve, and in that the cylindrical sleeve and check ring form a cylinder for the annular piston.

6. An arrangement according to claim 5, characterized in that a further spring means is arranged between the cylindrical sleeve and the check ring for axially tensioning the cylindrical sleeve and the check ring.

7. An arrangement according to claim 6, characterized in that an annular gap is formed between the cylindrical sleeve and the check ring for enabling a supply of pressure medium to the first cylinder-piston means.

8. A fuel injection pump arrangement for an internal combustion engine, the arrangement comprising adjustable regulator rod means for controlling a fuel delivery setting to the internal combustion engine, the regulator rod means including a first and second regulator rod part, means for mounting the first and second regulator rod parts so as to be axially movable toward and away from each other, spring means acting upon the first and second regulator rod parts so as to provide a reactive effect on a setting member of the fuel injection pump arrangement, and means for selectively stopping one of the first and second regulator rod parts from moving, characterized in that means are provided for selectively removing a force effect of the spring means acting upon the first and second regulator rod parts, the force effect removing means is an independent power source, the selective stopping means includes a first cylinder piston means adapted to cooperate with one of the first and second regulator rod parts and a housing, and in that the power source includes a second cylinder piston means cooperating with the first cylinder piston means and with the spring means, the first cylinder piston means includes an annular piston guided in the housing and connected with one of the first and second regulator rod parts and a piston means guided interiorly of the annular piston and slidable with respect to the other of the first and second regulator rod parts, and in that the other of the first and second regulator rod parts is operatively associated with the second cylinder piston means, one face of the piston means acts upon a shoulder of the other of said first and second regulator parts, and in that an additional spring means is disposed between the other face of the piston means and a stop provided on an additional regulator rod part.

9. A fuel injection pump arrangement for an internal combustion engine, the arrangement comprising adjustable regulator rod means for controlling a fuel delivery setting to the internal combustion engine, the regulator rod means including a first and second regulator rod part, means for mounting the first and second regulator rod parts so as to be axially movable toward and away from each other, spring means acting upon the first and second regulator rod parts so as to provide a reactive effect on a setting member of the fuel injection pump arrangement, and means for selectively stopping one of the first and second regulator rod parts from moving, characterized in that means are provided for selectively removing a force effect of the spring means acting upon the first and second regulator rod parts, the spring means is arranged between adjacent end faces of the first and second regulator rod parts, one end of the spring means engages one of the first and second regulator rod parts, a spring plate means is interposed between a second end of the spring means and the other of said first and second regulator rod parts, said spring plate means being mounted so as to be movable relative to the other of said first and second regulator rod parts, and in that means are provided for connecting the spring plate means with said force-effect removing means.

10. An arrangement according to claim 9, characterized in that the force-effect removing means includes a cylinder-piston means operatively connected with the selective stopping means.

11. An arrangement according to claim 10, characterized in that a further spring means is interposed between the spring plate means and a stop provided on an additional regulator rod part.

12. An arrangement according to one of claims 10 or 11, characterized in that the selective stopping means includes a second cylinder piston means adapted to cooperate with said one of said first and second regulator rod parts, and in that means are provided for enabling both of the cylinder-piston means to be simultaneously acted upon by a pressure medium.

* * * * *